US005480345A

United States Patent [19]

Bethea

[11] Patent Number: 5,480,345

[45] Date of Patent: Jan. 2, 1996

[54] KNIFE SHARPENER

[76] Inventor: Bobby J. Bethea, 6701 Brighton Ave., Batimore, Md. 21215

[21] Appl. No.: 254,752

[22] Filed: Jun. 6, 1994

[51] Int. Cl.[6] ..... B24B 9/04

[52] U.S. Cl. ..... 451/234; 451/237; 451/241; 451/372; 451/376

[58] Field of Search ..... 451/234–237, 451/241, 367, 371, 372, 376, 419, 457, 557, 558, 319, 125

[56] References Cited

U.S. PATENT DOCUMENTS

| | | | |
|---|---|---|---|
| 1,368,218 | 2/1921 | Chenette | 451/380 |
| 2,470,021 | 5/1949 | D'Avaucourt | 451/237 |
| 2,477,135 | 7/1949 | Marker, Jr. et al. | 451/237 |

*Primary Examiner*—Maurina T. Rachuba
*Assistant Examiner*—Eileen Morgan
*Attorney, Agent, or Firm*—Walter G. Finch; Nancy A. Smith

[57] ABSTRACT

This invention relates to a knife sharpener and more particularly to a knife sharpening device wherein the knife is clamped in a fixed position on a table or platform and the knife sharpening or grinding device is moved along the edge of the knife to be sharpened. The knife sharpening or grinding device is clamped into an adjustable arm which is attached to a roller. The roller slides along a track formed in the table or platform which has the identical configuration as the knife blade. Therefore, the edge of the sharpener or grinding device is maintained in constant contact with the edge of the knife during the sharpening. This prevents the problem of knives being sharpened unevenly and inaccurately, as is often seen in conventional knife sharpening methods.

6 Claims, 5 Drawing Sheets

KNIFE SHARPENER

BACKGROUND OF THE INVENTION

Generally, in the art of sharpening knives it is the practice to run the knife blade along the sharpener. That is the means to sharpen the knife, such as a grinding stone, a grinding wheel or a die grinder, is usually permanently positioned and the edge of the knife blade is moved along the sharpening means.

This requires a person to hold the knife and maintain the contact between the knife's edge and the grinding surface while that person is moving the edge of the knife along the grinding surface. A human cannot guarantee that the same amount of pressure is constantly applied to the knife's edge while grinding it.

Often this method of sharpening leads to a knife which is sharpened more at some points along the blade and less at others. This is a result of the uncontrollable variance in pressure inherent in this method.

A similar technique has been employed with knives or blades which are integral to a machine such as a saw or some type of cutting or slicing apparatus.

In U.S. Pat. No. 3,958,478, issued to Camper, a commodity slicing machine is provided with a non-rotatable honing stone which sharpens the knife as the knife rotates in the machine.

Another device where a sharpener device is part of a cutting machine is seen in the Pearl U.S. Pat. No. 4,033,214. This patent provides for a sharpener which hones the blades of a pattern cutting machine by rotating the blades against a stationary sharpener.

The Steiner U.S. Pat. No. 4,173,846 discloses a sharpening device to be mounted on the frame of an orbital saw. The blade is sharpened when it is rotated in contact with the stationary sharpener.

SUMMARY OF THE INVENTION

This invention relates to a knife sharpener. More particularly this invention relates to a knife sharpener for a draw knife such as is used in the meat cutting industry.

Presently these knives are sharpened by drawing them across a stone or grinding wheel. This can often result in a knife which is unevenly sharpened, due to the varying amount of pressure applied to the knife by the person doing the sharpening.

This present invention provides for a means to hold a knife and move the sharpener or grinder along the edge of the knife. The sharpener or grinder is held in a fixed position against the edge of the knife by an arm which connected to a rotatable handle. The rotatable handle is such that is runs along a track which is formed to match the exact shape of the knife blade.

Therefore, the grinder device, such as a die grinder would be positioned in a clamp attached to the arm so that the tip of the grinder will be in contact with the edge of the knife blade. The grinder is moved along the edge of the knife blade by moving the handle along the track.

This device does not require the application of pressure by the person sharpening the knife. The pressure between the knife blade and the grinder is provided by a system of clamping the knife into position on a table and clamping the grinder into position on an arm attached to a handle which runs along a track in the table.

This knife sharpener provides for an accurate cutting edge without having to move the knife along the grinding device. It also eliminates the chance of someone being cut while sharpening a knife.

Therefore it is an object of this invention to provide for a knife sharpening device which produces a consistent and accurate cutting edge to a knife blade.

It is another object of this invention to provided for a knife sharpening device which eliminates variations in the sharpness of a knife's edge as a result of human error.

It is a further object of this invention to provide for a knife sharpening device wherein the knife is clamped to a table and the sharpening device is clamped to an arm, which is attached to a handle which rotates along a track in the table.

BRIEF DESCRIPTION OF THE DRAWINGS

The above and other objects, features and advantages of the invention will become more readily apparent from the following with reference to the accompanying drawings in which.

DETAILED DESCRIPTION OF THE DRAWINGS

Figure 1:
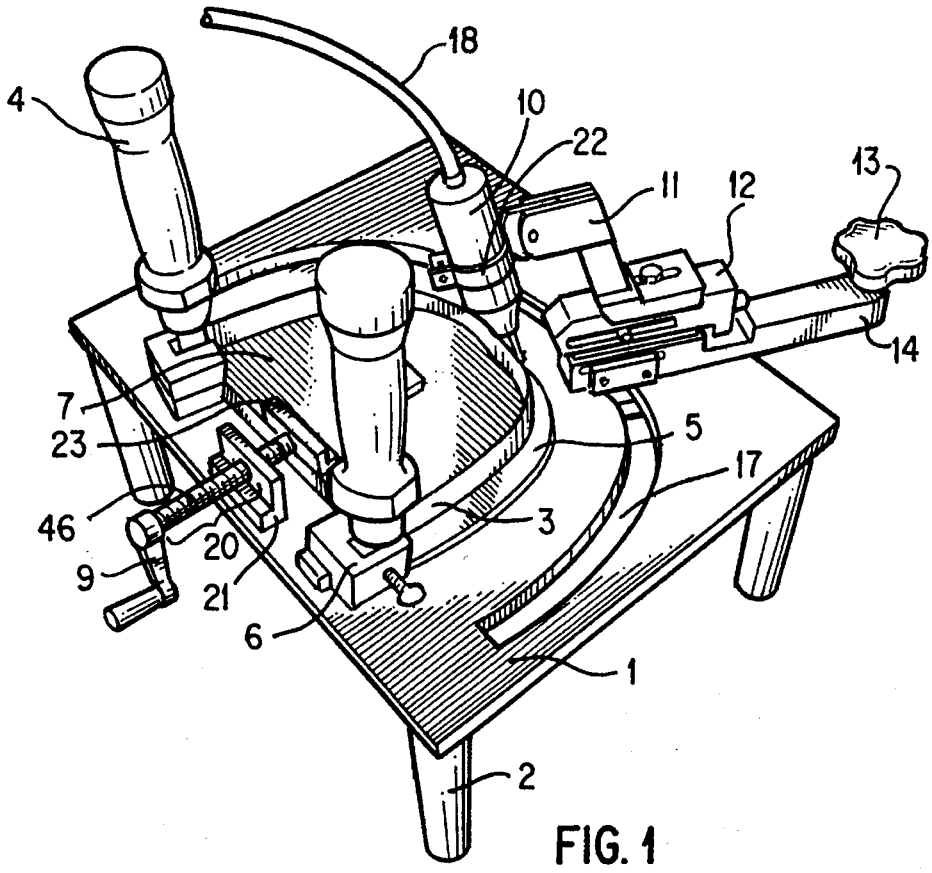
FIG. 1 is a perspective view of a knife sharpening device incorporating the features of this invention.

Referring now to FIG. 1, there is shown the device in a perspective view. It is comprised of a table 1 which is supported by legs 2. On top of the table, the knife 3 is clamped into place by a knife clamp 6. The knife clamp 6 braces the knife 3 at each end at the point where the knife blade 3 connects with the knife handle 4.

Figure 7:
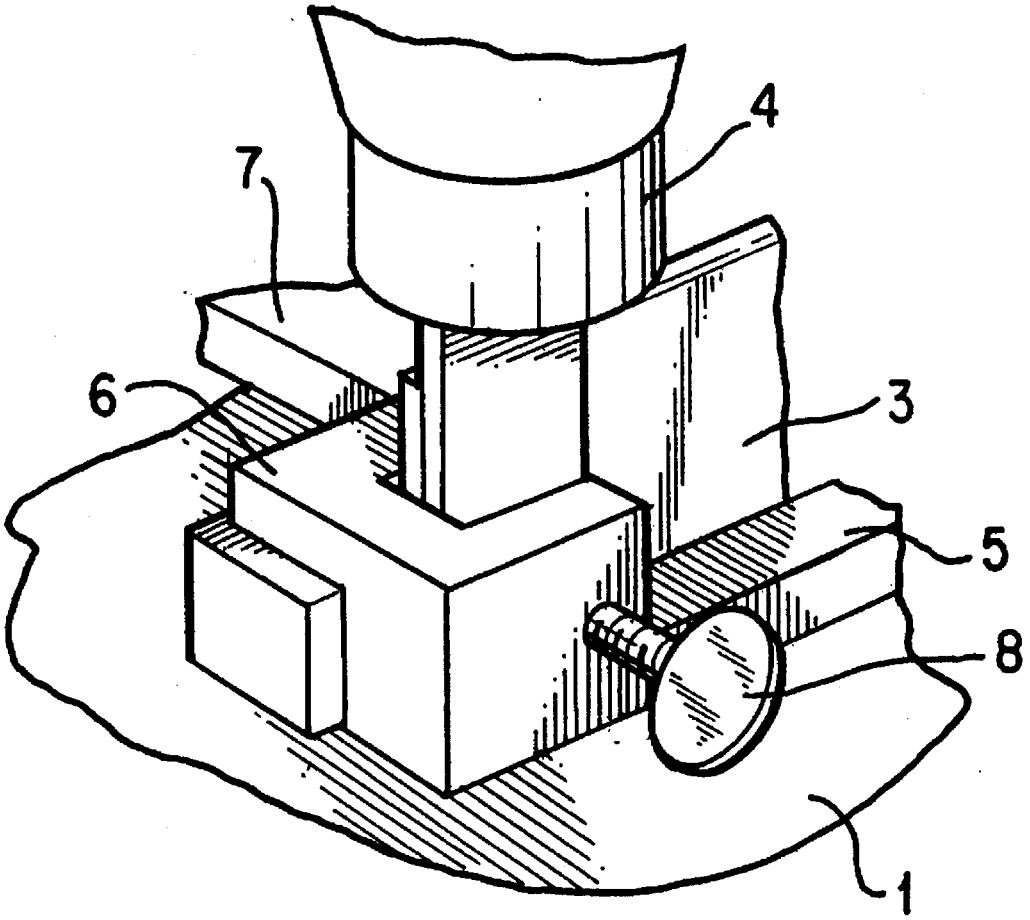
FIG. 7 is an enlarged perspective view of the knife clamping means of FIG. 1.

FIG. 7 shows the detail of this knife clamping mechanism. The knife 3 and knife handle 4 are held in these clamps 6 by the action of a thumb screw 8 as it is screwed into the knife clamp 6.

The knife is also held in place by use of a flat plate 7 which is movably positioned on top of the table 1. The outside edge of this flat plate 7 is designed to correspond to the exact shape of the knife blade 3. The knife guide 5 is mounted to the table 1 at the outer edge of the knife blade 3, such that the knife blade 3 is effectively arranged between the knife guide 5 and the flat plate 7.

Figure 3:
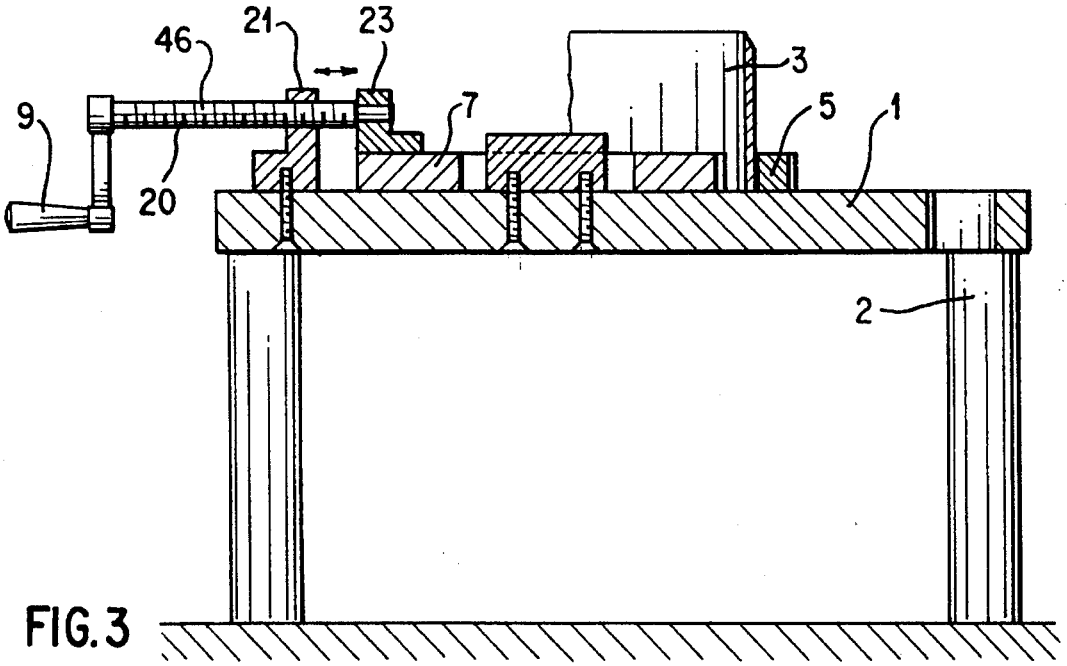
FIG. 3 is a right side elevational view of the table and knife clamping assembly of FIG. 1.

FIG. 3 shows the detail of the clamping mechanism for the flat plate 7. There is a shaft 46 having a crank handle 9 and the shaft is threaded at one end 20. The shaft 46 is positioned such that the threaded portion screws into to crank nut 21 which mounted to table 1. The narrower non-threaded portion of the crank 46 fits into an aperture in crank nut 23. When the crank handle 9 is turned the shaft 46 screws to the two crank nuts 21 and 23 and moves the flat plate 7 so that it clamps the knife blade 3 against the knife guide 5 and into position for sharpening.

FIG. 1 also show the clamping mechanism for the sharpening device. The sharpening device shown here is a die grinder 10 with the air being provided by the air supply line 18. The die grinder is the type well known in the art of sharpening knives. The tip of the die grinder 33 has a rotating wheel which is spin driven by pressurized air. The air is supplied to the die grinder through the air line 18 from an external air compressor device. As the tip of the die grinder 33 comes into contact with the knife blade 3 the rotation of the wheel sharpens the blade 3. The die grinder 10 is held by the grinder clamp 22. The grinder clamp 22 it tightened by the action of screw 47. The grinder clamp 22 is positioned at the end of the arm 11. The arm 11 is located on top of the compound base 12 which is connected to the radius handle 14.

The radius handle 14 is moved back and forth along the table 1 by means of the knob 13. The radius handle 14 moves the die grinder 10 along the knife blade 3 by rolling along a cam track 17 cut into the table 1. The cam track 17 is shaped to exactly match the outer configuration of the knife blade 3.

Figure 2:
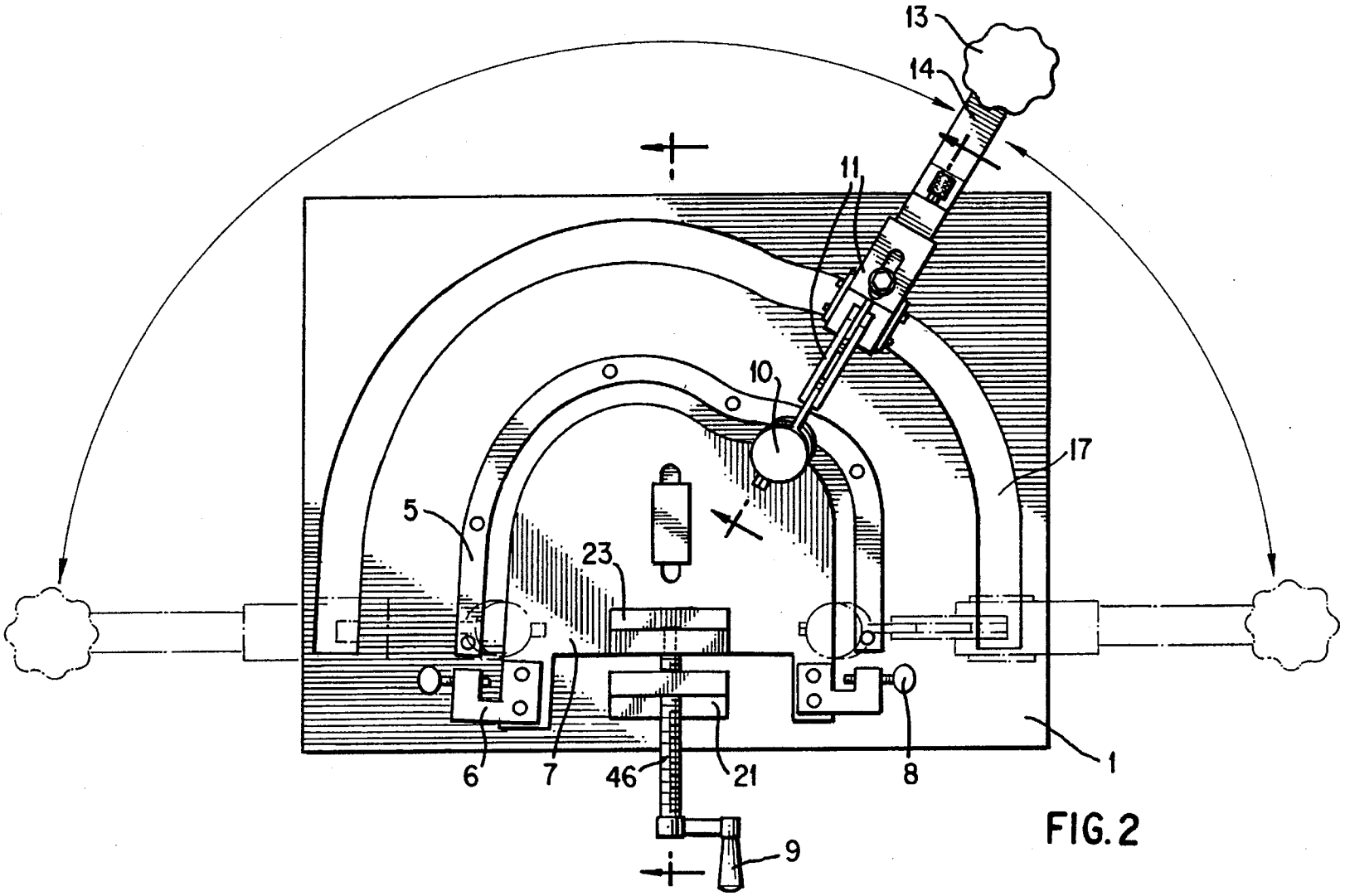
FIG. 2 is top perspective view of the device showing the rotational movement of the handle and arm holding the grinding device.

FIG. 2 clearly illustrates the movement of the radius handle 14, arm 11 and the die grinder 10 combination along the knife blade 19. By moving the radius handle 14 back and forth along the cam track 17 the die grinder 10 comes in contact with the entire length of the knife blade 3. This back and forth movement of the die grinder 10 ensures that the entire knife blade 3 will be sharpened.

Figure 4:
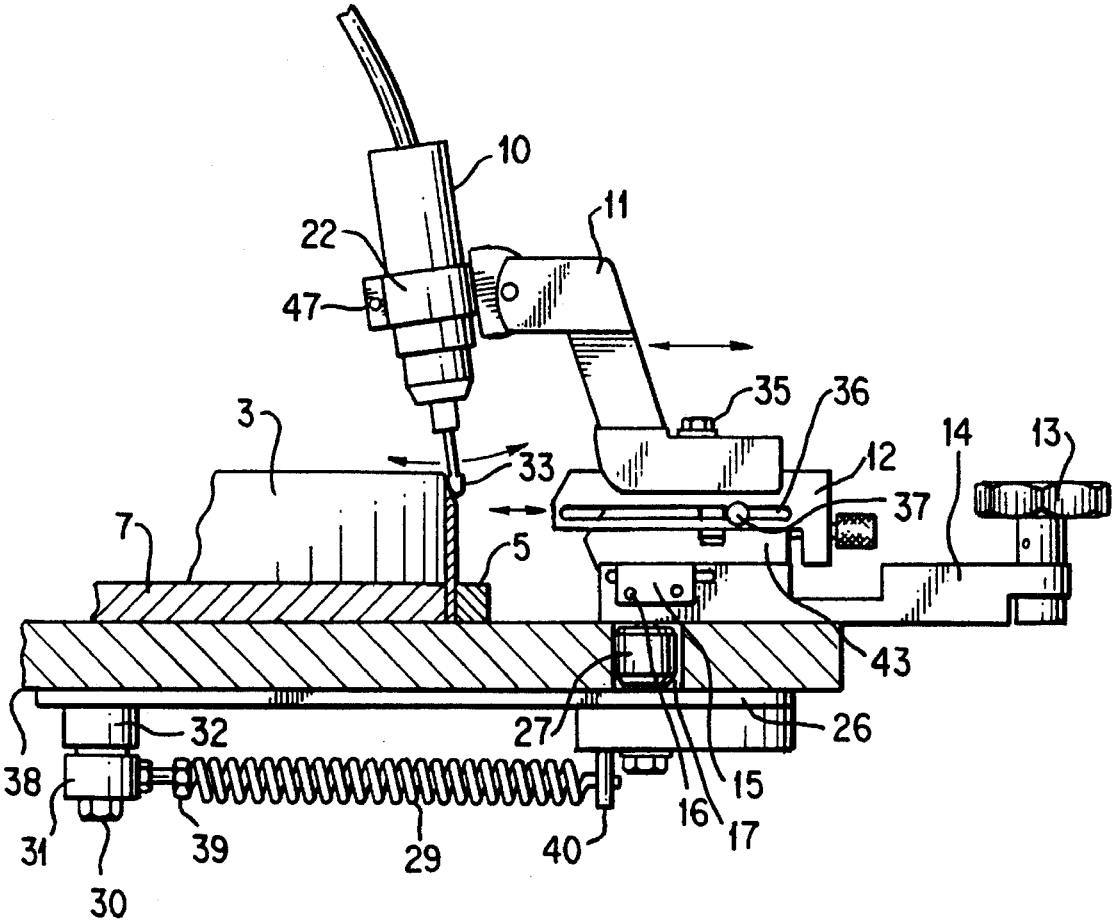
FIG. 4 is a right side elevational view of table and grinder clamping and rotatable arm assemblies of FIG. 1.

FIG. 4 shows the detail of the mechanism for holding and moving the die grinder 10. The die grinder is held directly by the grinder clamp 22. The grinder clamp 22 is pivotally gripped by the arm 11. The angle of the grinder clamp 22 can be adjusted by screw 48. The arm 11 is slidably positioned on the compound base 12. The bottom portion of the arm 11 has a cap screw track 34. The arm 11 is locked into position on top of the compound base by means of cap screw 35.

The compound base is also movably mounted onto the radius handle 14. Along the sides of the compound base is a screw track 36. The compound base is secured by means of at least one screw 37.

Along the sides of the radius handle 14 is positioned a right angle key 15. It held in place by two screws 16 which screw into the radius handle 14. The right angle key 15 holds the movable base 43 within the radius handle 14. The cam track roller 27 is positioned in the cam track 17.

On the underside of the table 1 is located the radial pivot clevis 26. This radial pivot clevis 26 acts to connect the cam track roller 27 and the radius handle 14 to a central pivot point 38. At this central pivot point is positioned one end of the radial pivot clevis 26, next to a pivot pin 32, next to a pivot collar 31 and secured to the table 1 by a cap screw 30. A screw 39 extends out of the side of the pivotal collar 31. One end of an expansion spring 29 is attached to this screw 39. The opposite end of the expansion spring 29 is attached to a spring retainer pin 40 extending from the bottom of the radial pivot clevis 26. The expansion spring 29 acts to maintain the close relationship between the cam track 17 and the cam track roller 27.

Figure 5:
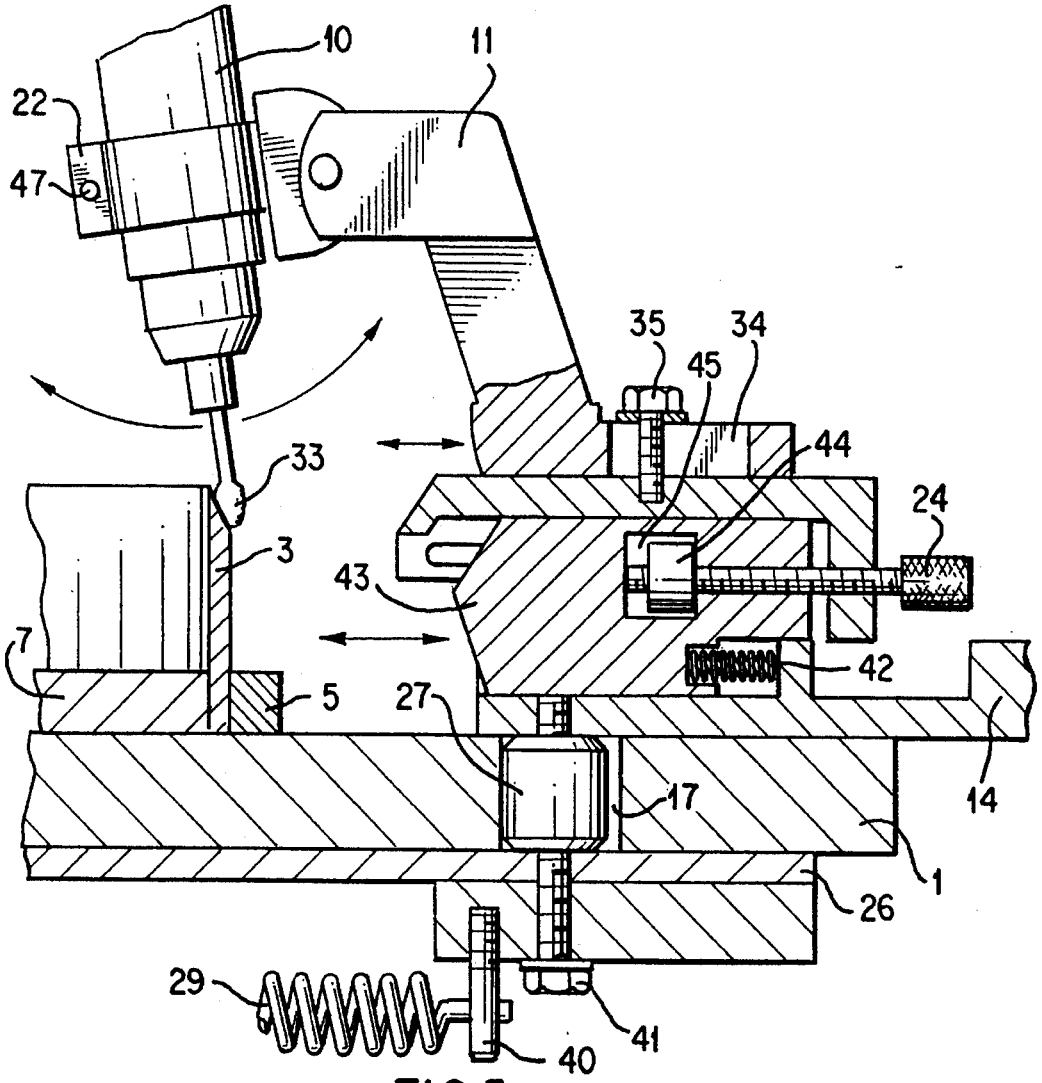
FIG. 5 is an enlarged right side perspective view of the grinder device clamping assembly of FIG. 4.

FIG. 5 is enlarged to show the detail of the connections between the grinder clamp 22, the arm 11, the compound base 12 and the radius handle 14. The cap screw 35 is shown in the cap screw track 34 fastening the bottom portion of the arm 11 to the top of the compound base 12. The arm 11 can be moved back and forth as indicated by the arrow, so that the cap screw 35 is located at any position along the cap screw track 34.

The compound base 12 is movably mounted on the movable base 43, and connected by a fine adjustment screw 24 which screws into a set collar 44 positioned in an aperture 45 of the movable base 43. The movable base 43 can slide back and forth along the radius handle 14 by means of a compression spring 42. This compression spring maintains the pressure between the die grinder tip 33 and the knife blade 3. The location of the die grinder 33 tip can be varied slightly once positioned against the knife blade 3 by the fine adjustment screw 24.

The cam track roller 27 is connected to the radial handle 14 and the radial pivot clevis 26 by means of a cap screw 41, which extends through all three pieces.

Figure 6:
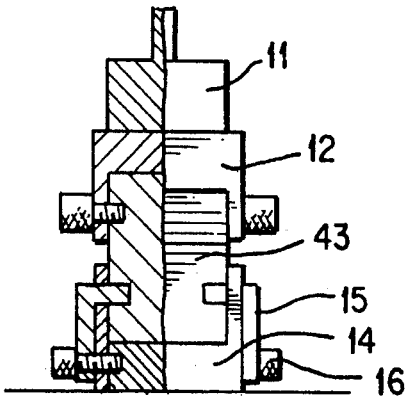
FIG. 6 is a cross sectional view of an arm assembly, one half showing the interior view and the other half showing the exterior view.

FIG. 6 is a cross-sectional view showing how the arm 11, the compound base 12, the movable base 43 and the radius handle 14 all fit together. It also shows a split view of the interior of these connections showing the screws 16 which hold the right angle key 15 in place as extending into the radius handle 14.

When the device is in use the die grinder 10 is positioned so that the die grinder tip 33 is in contact with the knife blade 19 as shown in FIGS. 4 and 5. When the user moves the knob 13 the cam track roller 27 moves along the cam track 17 such that the die grinder tip 33 is moved along the knife blade 3. The radial pivot clevis 26 pivots around the central pivot point 38. The expansion spring 29 maintains the same pressure on the cam track roller 27 for the entire length of the cam track 17. This provides the accuracy of the knife sharpener.

This represents only one embodiment of the invention. It is understood that this invention could be practiced on knives of different shapes as well as straight edged knives without departing form the scope of the claims of this invention.

What is claimed is:

1. A knife sharpening device, comprising:

a platform means;

a first clamping means attached to said platform means for clamping a cutting member, wherein said cutting member has a particular configuration;

a handle assembly having a top and a bottom;

a second clamping means for supporting a grinding device against said cutting member, wherein said second clamping means is attached to said top of said handle assembly;

roller means for moving said second clamping means, said roller means being rotatably attached to said bottom of said handle assembly;

track means formed in said platform for receiving said roller means therein, and wherein said track means has a configuration which is substantially the same as said configuration of said cutting member, such that by moving said handle assembly along said track means by rolling action of said roller and said grinding device remains in constant contact with said cutting member during sharpening.

2. A knife sharpening device, comprising:

a table;

at least one leg attached to said table to support said table;

a first clamping means attached to said table for clamping a knife, wherein said knife has a particular configuration;

a handle assembly having a top and a bottom;

a second clamping means for holding and supporting a grinding device against said knife, wherein said second clamping means is attached to said top of said handle assembly;

a roller rotatably attached to said bottom of said handle assembly for moving said handle assembly and said grinding device;

a track formed in said table for receiving said roller therein and having a configuration which is substantially the same as said configuration of said knife, such that by moving said handle assembly along said track by the rolling action of said roller, said grinding device remains in constant contact with said knife.

3. A knife sharpening device as recited in claim 2, wherein said clamping means for clamping a knife to said table further comprises, a clamp for clamping a handle of said knife to said table;

a flat plate attached to a top of said table and having an outer edge with a configuration which is substantially the same as said configuration of said knife;

a knife guide having a configuration substantially the same as said configuration of said knife and attached to said top of said table such that said knife is positioned between said flat plate and said knife guide for sharpening;

a pair of crank nuts, wherein one crank nut is attached to said table and another crank nut is attached to said flat plate and said crank nuts are positioned in a spaced apart face to face relationship;

a shaft means which fits into said crank nuts;

a crank handle attached to said shaft means for turning said shaft means within said crank nuts;

wherein said shaft means is threaded at one end and the action of said threaded end of said shaft means on said crank nuts causes said knife to be clamped between said flat plate and said knife guide.

4. A knife sharpening device, as recited in claim 2, wherein said clamping means for clamping a grinding device further comprises, a pivoting clamp for holding said grinding device;

a sliding arm connected to said pivoting clamp;

a compound base connected to said sliding arm and said handle means, wherein said sliding arm can be moved along a top of said compound base and locked into position and said compound base is connected to said handle means by a compression spring whereby said compression spring maintains pressure between said grinding device and said knife.

5. A knife sharpening device, as recited in claim 4, wherein said compound base further comprises a fine adjustment means for adjusting the position of said grinding device against said knife.

6. A knife sharpening device as recited in claim 2, further comprising, a clevis arm attached at one end to an underside of said table at a central pivot point and attached to said roller at an opposite end;

a spring means for acting on said clevis arm and said roller to maintain pressure between said roller and said track as said roller rolls within said track.

* * * * *